US006163933A

United States Patent [19]

Smith

[11] Patent Number: 6,163,933

[45] **Date of Patent: *Dec. 26, 2000**

[54] TIE RETAINING DEVICE

[76] Inventor: Albert E. Smith, 225 E. 16th St., Mishawaka, Ind. 46544

[ * ] Notice: This patent is subject to a terminal disclaimer.

[21] Appl. No.: 09/130,685

[22] Filed: Aug. 6, 1998

Related U.S. Application Data

[63] Continuation-in-part of application No. 08/944,808, Oct. 6, 1997, Pat. No. 5,926,923.

[51] Int. Cl.[7] ..... A41D 25/04

[52] U.S. Cl. ..... 24/66.2; 24/66.4; 24/66.5; 24/66.13

[58] Field of Search ..... 2/137, 138, 145, 2/336, 341; 24/49.1, 66.13, 66.5, 66.4, 66.2, 710.8, 356, 56, 60, 666, 667, 342.1; D11/202–205

[56] References Cited

U.S. PATENT DOCUMENTS

| | | |
|---|---|---|
| 309,659 | 12/1884 | Smith . |
| 345,935 | 7/1886 | Thal . |
| 361,886 | 4/1887 | Nichols . |
| 678,098 | 7/1901 | Bummert . |
| 745,445 | 12/1903 | Von Köppen . |
| 869,683 | 10/1907 | Balla et al. . |
| 907,398 | 12/1908 | Perrilliat . |
| 1,060,438 | 4/1913 | Dorney . |
| 1,290,368 | 1/1919 | Schwartz . |
| 1,358,244 | 11/1920 | Presley . |
| 1,531,969 | 3/1925 | Mitchell . |
| 1,573,885 | 2/1926 | Weisbaum . |
| 1,647,407 | 11/1927 | Hostetter . |
| 1,737,632 | 12/1929 | Audet . |
| 1,909,280 | 5/1933 | Kepley . |
| 2,000,127 | 5/1935 | Desrosiers . |
| 2,008,666 | 7/1935 | Ekander . |
| 2,013,061 | 9/1935 | Loewinsohn . |
| 2,060,040 | 11/1936 | Cobb . |
| 2,068,454 | 1/1937 | Helske . |
| 2,121,402 | 6/1938 | Knoebel, Jr. . |
| 2,168,946 | 8/1939 | Rogers . |
| 2,181,443 | 11/1939 | Zeman . |
| 2,384,694 | 9/1945 | Quin . |
| 2,430,952 | 11/1947 | Sawinski . |
| 2,465,787 | 3/1949 | Bliek . |
| 2,592,155 | 4/1952 | Johnson . |
| 2,636,179 | 4/1953 | Churchill . |
| 2,755,530 | 7/1956 | Martin . |
| 3,019,445 | 2/1962 | Hirsch et al. . |
| 3,116,525 | 1/1964 | Koby . |
| 3,942,192 | 3/1976 | Harris . |
| 3,968,544 | 7/1976 | Sinclair . |
| 4,099,300 | 7/1978 | Wolak . |
| 4,686,716 | 8/1987 | Burns . |
| 4,839,945 | 6/1989 | Price et al. . |
| 4,959,889 | 10/1990 | Ciaravino . |
| 5,031,284 | 7/1991 | Ray . |
| 5,046,221 | 9/1991 | Walker . |
| 5,097,569 | 3/1992 | Erickson . |
| 5,235,730 | 8/1993 | Townsend . |

FOREIGN PATENT DOCUMENTS

| | | |
|---|---|---|
| 712872 | 8/1954 | United Kingdom . |

*Primary Examiner*—James R. Brittain
*Attorney, Agent, or Firm*—Barnes & Thornburg

[57] ABSTRACT

A tie retaining device according to the present invention includes a fastener part having a front side and a back side, the front side supporting a pair of opposed, laterally projecting barbs, and the back side including an eyelet. The retaining device also includes a retainer clip for connecting to either a button on a shirt or the centerline of the shirt to secure the retainer clip to the shirt, and a prong for removably coupling with the eyelet of the fastener part. The fastener part barbs are inserted into the rear, folded back flaps of a tie body to attach the fastener part to the tie. The narrow tie tail is then inserted through an elongated opening in the fastener part. The eyelet on the back side of the fastener part is then threaded onto the prong of the retainer clip. In an alternate embodiment, the retainer clip is replaced by a retainer chain which is attached at one end to the center of a rod, and at the other end to a clasp. The rod is threaded into a shirt button hole to secure the retainer chain to the shirt, and the clasp is coupled to the eyelet to connect the fastener part to the retainer chain.

38 Claims, 7 Drawing Sheets

TIE RETAINING DEVICE

This is a continuation-in-part of application Ser. No. 08/944,808, filed Oct. 6, 1997 now U.S. Pat. No. 5,926,923.

BACKGROUND AND SUMMARY OF THE INVENTION

The present invention relates to a removable device for securing a tie to the front of a shirt, and retaining the tie in a substantially centered, straight-down position.

Many men wear neckties which, as a result of wind or movement of the wearer, tend to separate, flip over the man's shoulder, or twist. Such unrestrained movement is annoying and unattractive. Additionally, unrestrained neckties are more likely to be damaged. As the wearer bends forward, such as to reach across a table, the necktie may fall into food or liquids.

One embodiment of the present invention provides a tie retaining device which includes a retainer clip and a fastener part. The fastener part forms an elongated ring with a front side and back side. The front side supports a pair of opposed, laterally projecting barbs. The back side includes an eyelet. The barbs are inserted into the rear flaps of the main tie body and the tie tail is threaded through the narrow opening in the elongated ring. The retainer clip includes a flat rear part with a slot for sliding onto one of the shirt buttons, thereby securing the retainer clip to the shirt. The retainer clip also includes an upturned prong for removably coupling with the fastener part eyelet. Once the retainer clip is attached to the button, the eyelet of the fastener part is threaded onto the retainer clip prong, thereby retaining the tie adjacent the shirt in a centered, straight-down position.

According to another embodiment of the present invention, a retainer chain is substituted for the retainer clip. The chain has a clasp on one end for removably coupling to the fastener part eyelet and a rod on the other end for insertion into a button hole. Unlike the retainer clip, the retainer chain permits some movement of the tie.

According to another embodiment of the invention, the retainer clip is formed as a U-shaped clip which attaches to the centerline of a shirt (as opposed to a button) by compressing the centerline between the first and second members, or legs, which form the U shape. This configuration of retainer clip may also include an actuator which causes the first and second members of the retainer clip to move between an opened position and a closed position wherein the members engage the centerline of the shirt.

Various prongs may be substituted for the upturned prong described above. For example, a pair of opposed arms which form a gap for receiving the fastener part eyelet may be connected to any of the retainer clip designs described herein. The arms may be attached to the retainer clip in, for example, a vertical or horizontal orientation relative to the centerline of the shirt.

Additionally, the fastener part of the present invention may include, instead of a pair of opposed, laterally projecting barbs, a pin which is movable, for example, by flexing or by a pivotal connection to the fastener part, toward and away from the front side of the fastener part to facilitate its connection to the tie.

Other features of the present invention will be apparent upon consideration of the following description of exemplary embodiments and the accompanying drawings.

DETAILED DESCRIPTION OF EMBODIMENTS OF THE INVENTION

The embodiments described herein are not intended to be exhaustive or to limit the invention to the precise forms disclosed. Rather, the embodiments selected for description are disclosed so that others skilled in the art may use their teachings.

Figure 1:
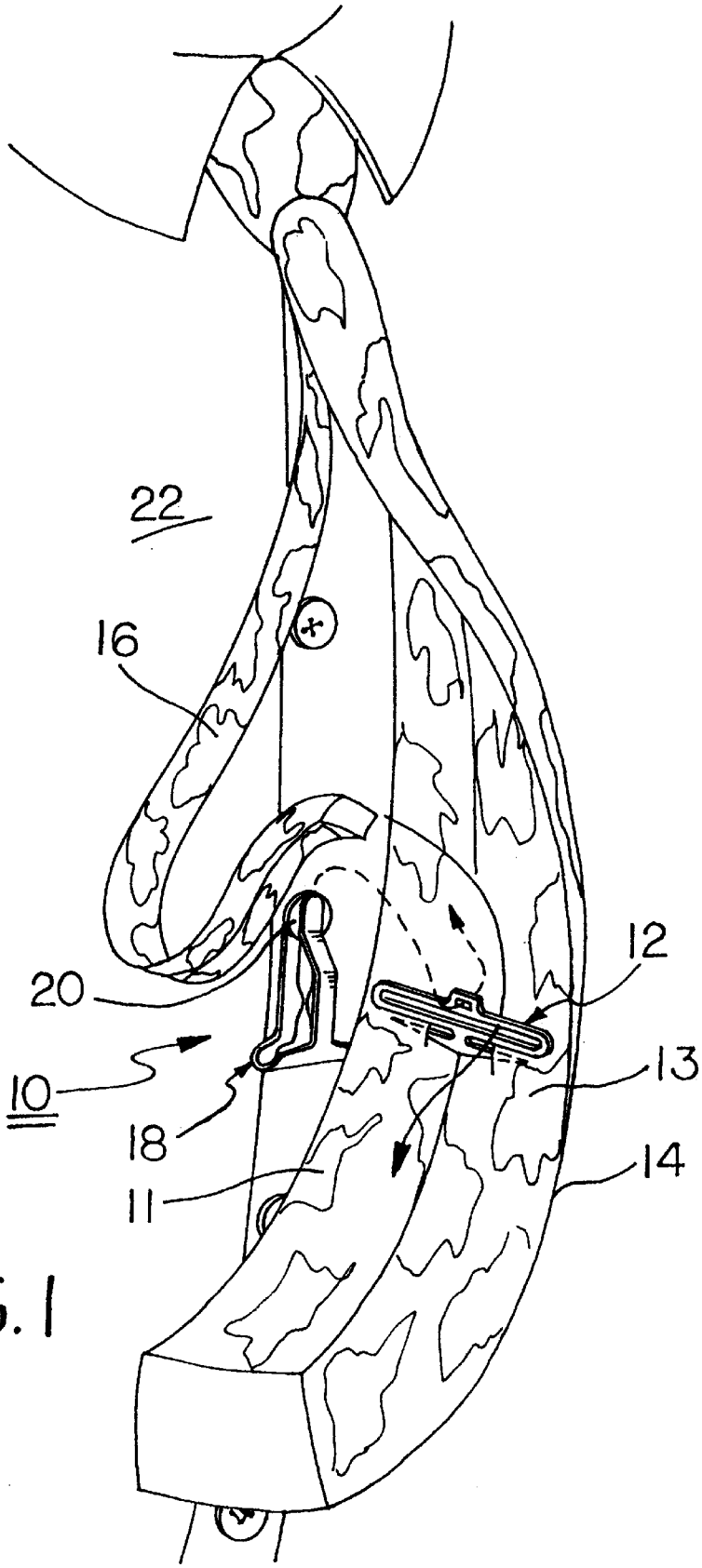
FIG. 1 is a perspective view of a tie retaining device according to the present invention.

FIG. 1 shows a tie retaining device according to the present invention, generally designated 10. Device 10 generally includes a fastener part 12 for attachment to the folded back flaps 11, 13 of the main tie body 14, and a retainer clip 18 for attachment to a selected button 20 of a shirt 22.

Figure 2:
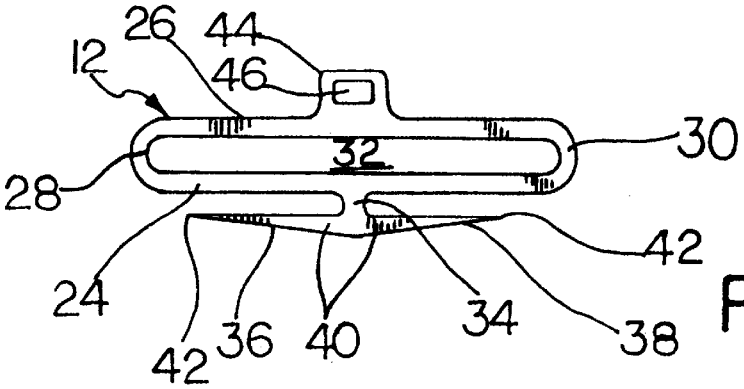
FIG. 2 is a top plan view of a fastener part according to the present invention.

Referring now to FIG. 2, fastener part 12 includes a front side 24, a back side 26, and a pair of end segments 28, 30, collectively defining an elongated, narrow opening 32. Front side 24 includes an arm 34 which carries a pair of opposed, laterally projecting barbs 36, 38. Each barb includes a first end 40 connected to arm 34, and a second end 42. In one embodiment, barbs 36, 38 taper from one width at their first ends 40 to a point at their second ends 42. The back side 26 of fastener part 12 includes an eyelet 44 which includes an eyelet opening 46.

Figure 3:
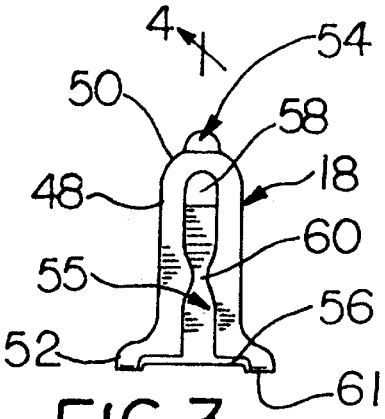
FIG. 3 is a rear elevational view of a retainer clip according to the present invention.
Figure 4:
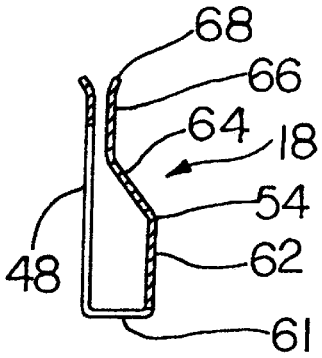
FIG. 4 is a cross-sectional view taken substantially along line 4—4 of FIG. 3.

FIGS. 3 and 4 show a retainer clip 18 according to the present invention. Retainer clip 18 is shown as a one-piece construction, including a flat rear part 48 with an upper end 50 and a lower end 52, and a prong 54. Rear part 48 includes an opening or slot, generally designated 55, for receiving a button 20. Button-receiving opening 55 includes an inlet portion 56 having a wide dimension to accommodate the diameter of button 20, a closed portion 58 adjacent upper end 50 of rear part 48, and a constricting portion 60 with a reduced dimension between upper end 50 and lower end 52.

A web 61 connects rear part 48 to prong 54. Prong 54 includes a first segment 62 which is spaced away from and substantially parallel to rear part 48, a second segment 64 which converges toward rear part 48, a third segment 66 which is adjacent rear part 48 relative to the first segment 62, and a fourth part 68 which diverges slightly away from rear part 48 to receive eyelet 44 as described in greater detail herein.

Figure 5:
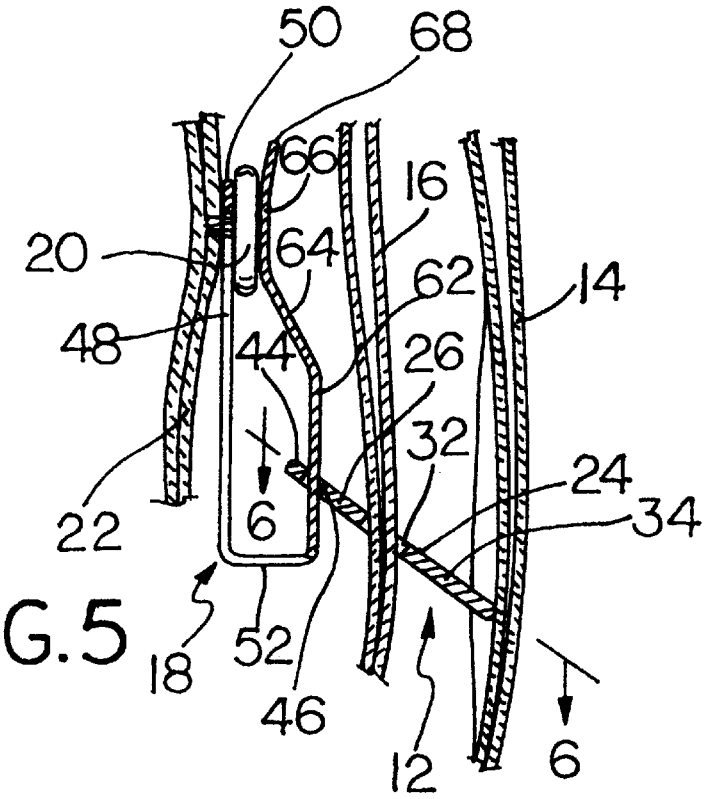
FIG. 5 is a fragmented, side elevational view, shown partly in section, of a tie retaining device according to the present invention mounted to a shirt and retaining a tie.

In use, retainer clip 18 is attached to a selected button 20 of shirt 22 by sliding the retainer clip onto and behind the button. Retainer clip 18 is held against shirt 22 directly above button 20 and moved downwardly so that inlet portion 56 of button-receiving opening 55 shifts over the button 20. As retainer clip 18 is slid further downwardly, the threads attaching button 20 to shirt 22 travel along button-receiving opening 55 between constricting portion 60 to closed portion 58 as shown in FIGS. 1 and 5. When so positioned, third segment 66 of prong 54 engages button 20 and is biased toward button 20 by the resiliency of the material from which the prong is formed, such as metal, plastic, or the like. Retainer clip 18 is prevented from being accidentally lifted upwardly off of button 20 by the compressive engagement between third segment 66 and button 20 and by constricting portion 60 of button-receiving opening 55. Note that the configuration of opening 55 allows a range of positioning on button 20, and also allows retainer clip 18 to rotate about button 20.

Fastener part 12 is next attached to the rear of the main tie body 14 at a location corresponding to the location of retainer clip 18 when the tie hangs in its normal position. Fastener part 12 is attached by inserting prongs 36, 38 through folded back, rear flaps 11, 13 of tie body 14. Fastener part 12 is attached in perpendicular relationship to the length of tie body 14 so that narrow opening 32 is positioned to receive tie tail 16. After tie tail 16 is threaded through narrow opening 32 (as indicated by the solid direction arrow in FIG. 1), eyelet 44 is slid onto prong 54 (as suggested by the dotted direction arrow in FIG. 1). The out-turned fourth segment 68 of prong 54 is threaded into eyelet opening 46. As eyelet 44 is shifted downwardly onto prong 54, eyelet 44 forces third segment 66 to separate slightly from button 20 against the biasing force of prong 54. Eyelet 44 slides over second segment 64 and is held in a retained position on first segment 62 of prong 54 as shown in FIG. 5.

Figure 6:
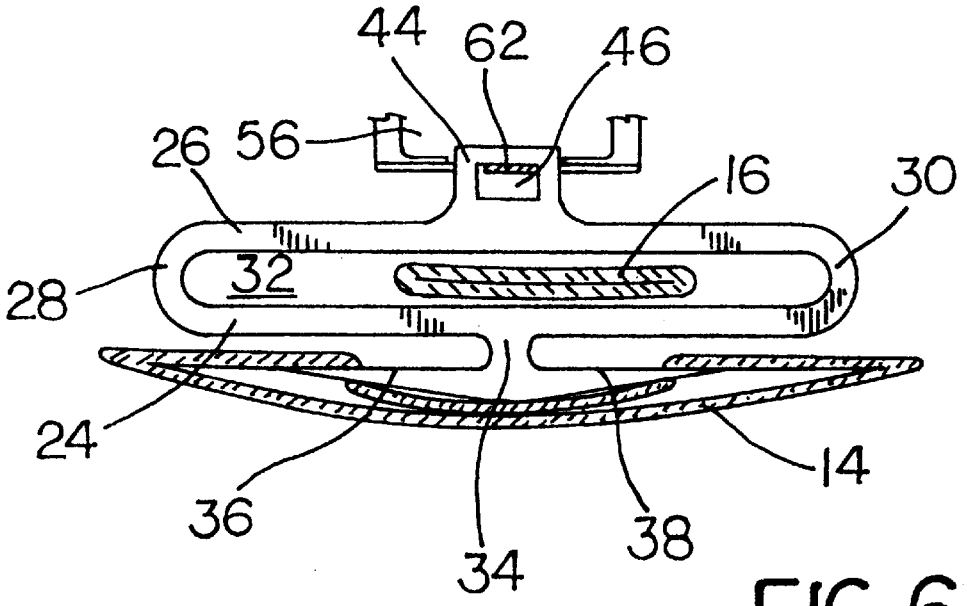
FIG. 6 is a fragmented cross-sectional view taken substantially along line 6—6 of FIG. 5.

Once threaded onto prong 54, eyelet 44 is prevented from accidentally shifting upwardly off of prong 54 by the compressive engagement between third segment 66 of prong 54 and button 20. As best shown in FIGS. 5 and 6, tie tail 16 is held adjacent tie body 14 by narrow opening 32, and the entire tie assembly is held in a substantially stationary position relative to button 20 by the interlocking connection between prong 54 and eyelet 44.

Figure 7:
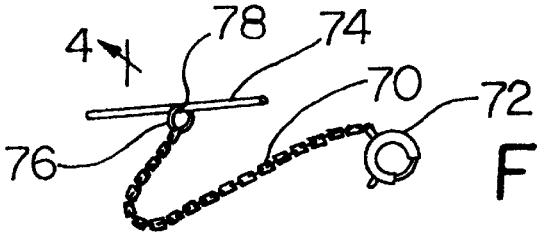
FIG. 7 is a perspective view of a retainer chain according to the present invention.

FIG. 7 shows a retainer chain 70 which may be substituted for retainer clip 18 in an alternate embodiment of the present invention. Retainer chain 70 includes a conventional clasp 72 on one end having a retractable locking hook and a rod 74 on the other end. Rod 74 is connected to chain 70 by link 76 which is threaded through a bore 78 located at the center of rod 74.

Retainer chain 70 is removably connected to shirt 22 by inserting rod 74 through a button hole in the shirt (not shown). The length of rod 74 and the central connection location of link 76 effectively prevent rod 74 from slipping through the button hole during normal wear. Clasp 72 is then attached to eyelet 44 in the standard fashion. Consequently, tie 14 and tie tail 16 are retained adjacent shirt 22, but some movement of the tie is permitted by the length of chain 70.

Figure 8:
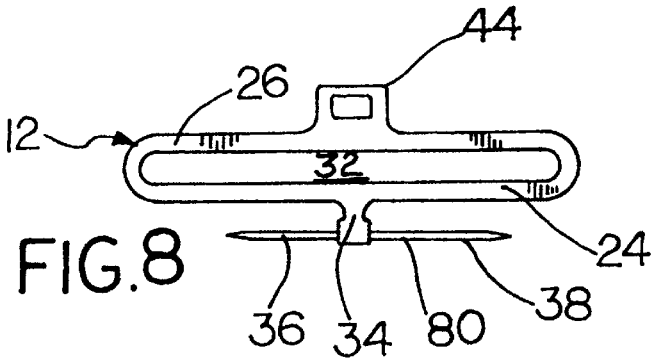
FIG. 8 is a top plan view of another embodiment of a fastener part according to the present invention.

FIG. 8 shows an alternate embodiment of fastener part 12 wherein barbs 36, 38 are replaced by a double-pointed pin 80 attached to arm 34 such as by welding or a compressive attachment wherein arm 34 is folded back onto itself around pin 80. As should be apparent from the figure, pin 80 is connected to arm 34 at a point offset from the center of pin 80. In the embodiment shown, one side of pin 80 (which constitutes barb 38) is approximately one-third longer than the other side of pin 80 (which constitutes barb 36). These length proportions make it easier to attach fastener part 12 to folded back flap portions 11, 13 of tie body 14. The longer end 38 of pin 80 is first inserted into one flap portion, and more readily remains threaded into that flap portion due to its length as fastener part 12 is shifted in the opposite direction so that the other end 36 of pin 80 threads into the other flap portion. Once attached to the tie, this embodiment is coupled to retainer part 18 in the manner described above.

Figure 9:
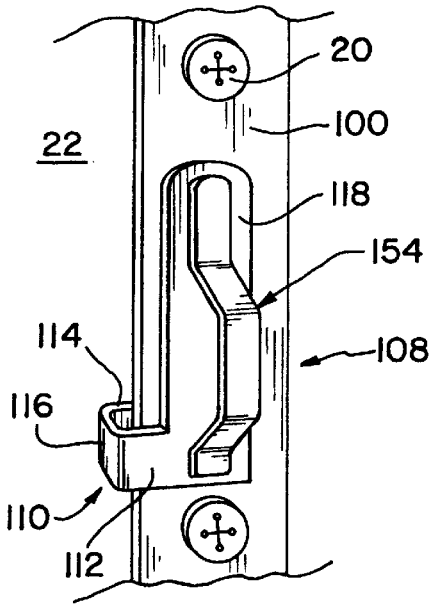
FIG. 9 is a perspective view of another embodiment of a retainer clip according to the present invention.

FIGS. 9 through 12, 14, and 15 show various additional embodiments of the present invention, all of which attach to shirt 22 at a location between buttons 20 on centerline 100, unlike retainer clip 18 which attaches to buttons 20. FIG. 9 shows a modified retainer clip 108 having a prong 154 which is similar to prong 54 as shown in FIGS. 3 and 4. Prong 154 extends perpendicularly from U-shaped rear part 110 along the front of centerline 100. Rear part 110 includes a first member 112 and a second member 114 which is connected to first member 112 by web 116. Rear part 110 also includes a third member 118 which is held against centerline 100 when first and second members 112, 114 are clipped onto centerline 100.

Figure 9A:
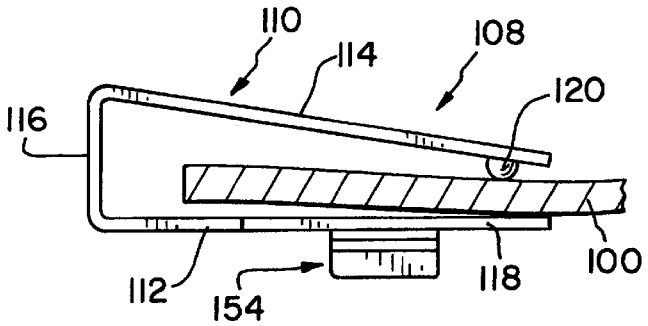
FIG. 9*a* is a top plan view of the retainer clip shown in FIG. 9.

As best shown in FIG. 9*a*, rear part 110 is formed such that first and second members 112, 114 converge toward one another with distance from web 116. As such, first and second members 112, 114 are biased into a closed position wherein first and second members 112, 114 cooperatively compress centerline 100 thereby clipping retainer clip 108 to shirt 22. Web 116 is resilient so that first and second members 112, 114 may be held apart by the user, positioned onto centerline 100, and released to permit first and second members 112, 114 to return to the relaxed, closed position shown in FIG. 9*a*. Of course, removal of retainer clip 108 is accomplished by reversing the above-described steps.

Retainer clip 108 also includes a protrusion 120 connected to second member 114 to compress into centerline 100 when retainer clip 108 is clipped onto shirt 22. Protrusion 120 becomes embedded into centerline 100, thereby helping to maintain retainer clip 108 in its originally clipped position. Of course, as set forth above in the description of retainer clip 18, once retainer clip 108 is clipped to centerline 100, fastener part 12 is coupled to prong 154.

Figure 10:
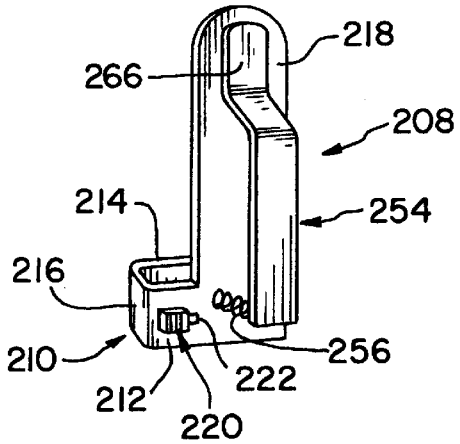
FIG. 10 is a perspective view of another embodiment of a retainer clip according to the present invention.
Figure 10A:
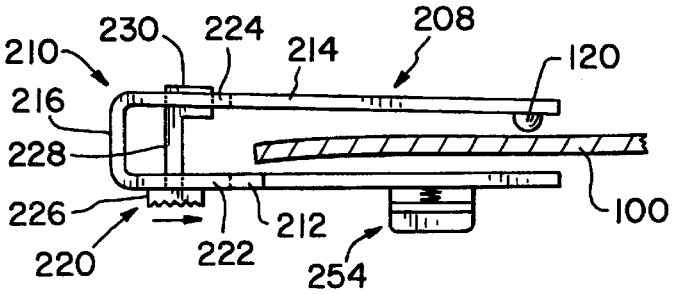
FIGS. 10*a* and 10*b* are top plan views of the retainer clip shown in FIG. 10.

FIG. 10 shows another embodiment of the retainer clip according to the present invention. Retainer clip 208 includes a rear part 210 which is similar to rear part 110 described above. However, rear part 210 is formed such that first member 212 is substantially parallel to second member 214 when rear part 210 is in its relaxed position, as shown in FIG. 10*a*. Accordingly, rear part 210 is normally opened.

Figure 10B:
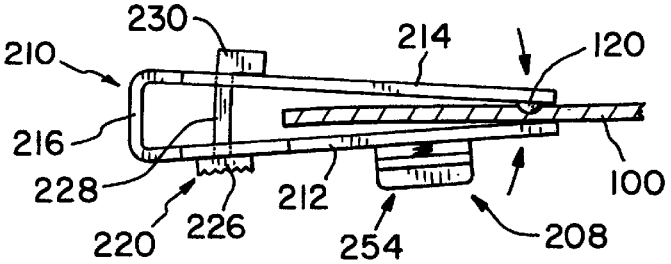

Rear part 210 includes an actuator 220 which extends through an opening 222 formed in first member 212 and an opening 224 formed in second member 214. Actuator 220 includes a head 226, a rod 228, and a rear projection 230. As best shown in FIGS. 10*a* and 10*b*, when retainer clip 208 is in its open position, projection 230 remains partially recessed within opening 224. Retainer clip 208 is attached to centerline 100 by compressing first and second members 212, 214 toward one another and into engagement with centerline 100. Retainer clip 208 is locked in its closed position shown in FIG. 10*b* by sliding actuator 220 toward prong 254. Rod 228 of actuator 220 travels within openings 222, 224 (which, in this embodiment, are slots) and projection 230 engages second member 214. Projection 230 and head 226 (which engages first member 212) prevent first and second members 212, 214 from returning to their normal, spaced apart, parallel orientation. Actuator 220 thereby maintains retainer clip 208 in its closed position shown in FIG. 10*b*. Of course, various other structures could accomplish the same locking function of the sliding actuator of retainer clip 208.

Retainer clip 208 also includes a modified prong 254. Prong 254 includes a biasing member 256 which provides a resilient or flexible connection between rear part 210 and prong 254. In the embodiment shown in FIG. 10, biasing member 256 is a spring which is welded or otherwise connected at one end to first member 212, and at the other end to prong 254. As such, prong 254 can be moved away from third member 218 of rear part 210 to receive eyelet 44 of fastener part 12. Once fastener part 12 is coupled to prong 254, biasing member 256 holds third segment 266 of prong 254 adjacent third member 218 to prevent fastener part 12 from accidentally decoupling from prong 254.

Figure 11:
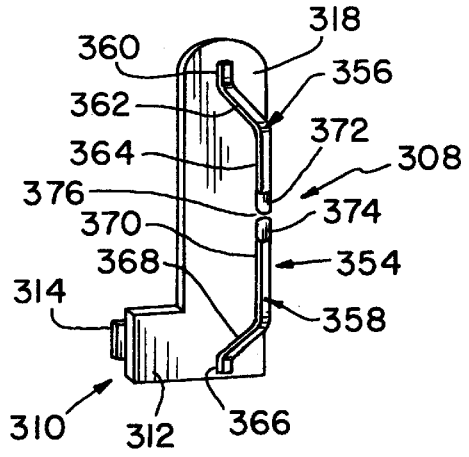
FIG. 11 is a perspective view of yet another embodiment of the retainer clip according to the present invention.
Figure 11A:
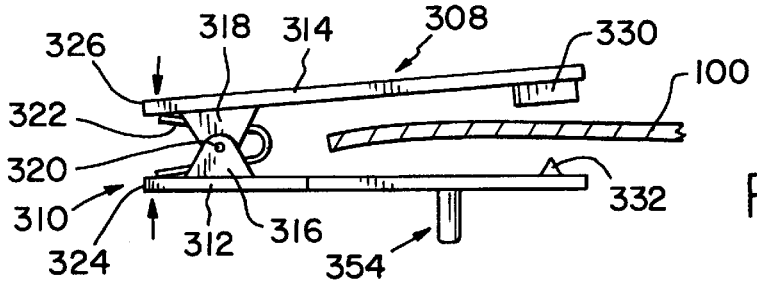
FIGS. 11*a* and 11*b* are top plan views of the retainer clip shown in FIG. 11.
Figure 11B:
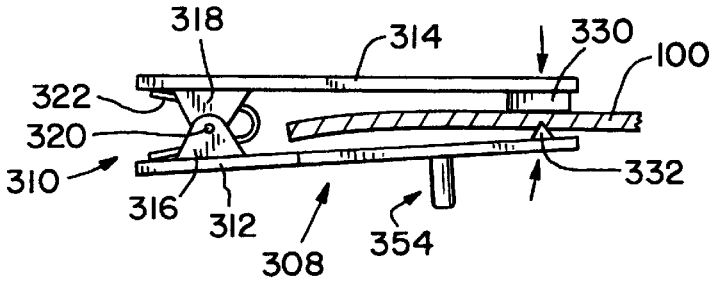

FIG. 11 shows yet another embodiment of a retainer clip according to the present invention. Retainer clip 308 includes a first member 312 and a second member 314 which are coupled together for pivotal movement relative to one another as best shown in FIGS. 11*a* and 11*b*. First member 312 includes a pair of extensions 316 (only one shown), and second member 314 includes a similar pair of aligned extensions 318. A pivot rod 320 extends through extensions 316 and 318. A spring 322 is retained between first member 312 and second member 314 such that it applies a biasing force to ends 324, 326 of first member 312 and second member 314, respectively, to cause the first and second members to pivot toward one another about pivot rod 320. As such, retainer clip 318 is attached to centerline 100 by urging ends 324, 326 of first and second members 312, 314, respectively, toward one another in the direction of the arrows shown in FIG. 11*a*, positioning retainer clip 308 such that centerline 100 is between first and second members 312, 314, and releasing ends 324, 326 so that spring 322 expands and first and second members 312, 314 pivot toward one another into the closed position shown in FIG. 11*b*.

As best shown in FIGS. 11*a* and 11*b*, retainer clip 308 also includes a protrusion 330 connected to second member 314 and a barb 332 attached to first member 312. When retainer clip 308 is in its closed position (FIG. 11*b*), protrusion 330 engages one side of centerline 100 and barb 332 pierces or otherwise engages the other side of centerline 100, thereby retaining retainer clip 308 in its original clipped position on centerline 100.

Retainer clip 308 also includes a modified prong 354 which includes a pair of opposed arms 356, 358. Arm 356 includes a first portion 360 which is welded or otherwise attached to third member 318 of retainer clip 308, a second portion 362 which angles outwardly relative to third member 318, and a third portion 364 which extends in substantially parallel relationship to third member 318. Arm 358 includes similar portions 366, 368, 370 and is attached at first portion 366 to first member 312 of retainer clip 308. Third portions 364 and 370 are substantially axially aligned. Third portion 364 carries a flexible member 372 at its end. Third portion 370 carries a flexible member 374 at its end. A slight gap 376 is formed between flexible members 372 and 374.

In use, prong 354 couples to fastener part 12 by urging eyelet 44 between flexible members 372, 374. Fastener part 12 may then shift freely vertically along arms 356, 358 which then extend through opening 46 in eyelet 44. The resiliency of flexible members 372, 374 permits the insertion and removal of eyelet 44 onto and off of prong 354. However, flexible members 372, 374 should preferably be formed of material which provides sufficient stiffness to prevent the accidental removal of eyelet 44 during use.

Figure 12:
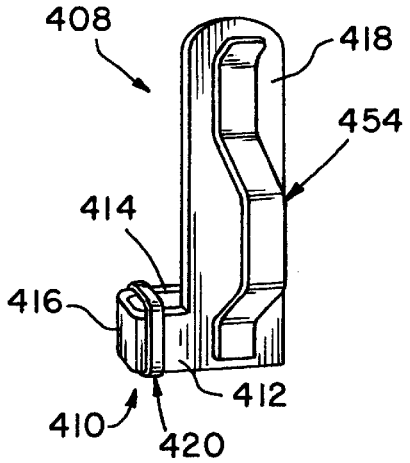
FIG. 12 is a perspective view of yet another embodiment of a retainer clip according to the present invention.
Figure 12A:
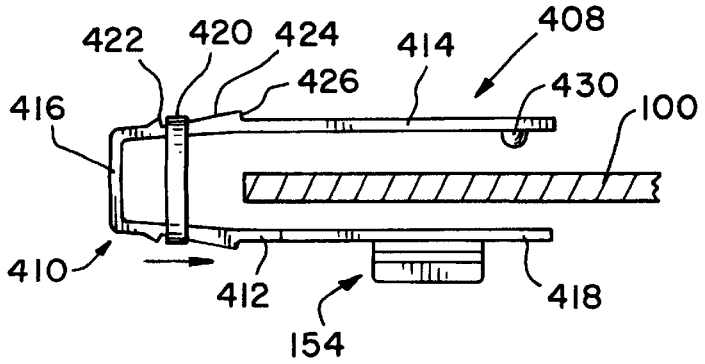
FIGS. 12*a* and 12*b* are top plan views of the retainer clip shown in FIG. 12.
Figure 12B:
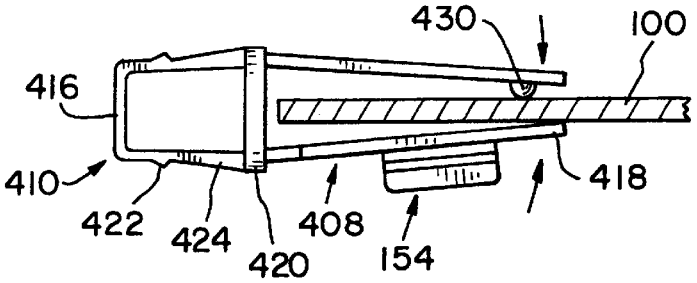

FIGS. 12, 12*a*, and 12*b* show yet another embodiment of a retainer clip according to the present invention. Retainer clip 408 features a modified actuator 420. Actuator 420 is formed in the shape of a continuous ring which encircles first member 412 and second member 414. As best shown in FIG. 12*a*, rear part 410 of retainer clip 408 is formed such that first member 412 is substantially parallel to second member 414. Each of the first and second members 412, 414 include a detent 422 adjacent web 416 to prevent actuator 20 from sliding off of rear part 410. Also, each of first and second members 412, 414 include an inclined portion 424 which increases in width with distance from detent 422. Inclined portions 424 terminate at a step 426.

In operation, as retainer 420 is slid along first and second members 412, 414 in the direction of the arrow shown in FIG. 12*a*, the cooperation between actuator 420 and inclined portions 424 causes first and second members 412, 414 to move toward one another. When actuator 420 is moved off of inclined portions 424, steps 426 retain actuator 420 in the position shown in FIG. 12*b*, thereby locking rear part 410 into compressive engagement with centerline 100. Second member 414 is also shown in FIGS. 12*a* and 12*b* as carrying a protrusion 430 similar to that shown in FIGS. 9*a*, 10*a*, and 10*b*.

Figure 13:
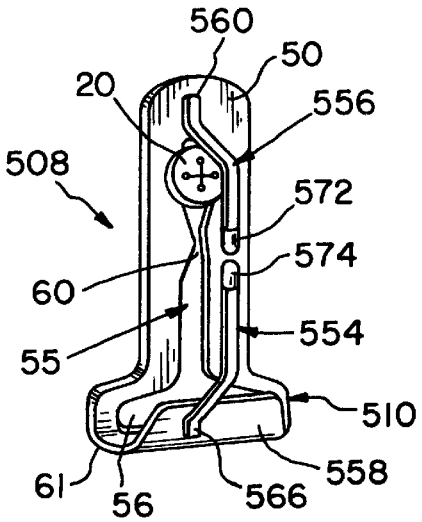
FIG. 13 is a perspective view of another embodiment of a retainer clip according to the present invention.

The retainer clip embodiment 508 shown in FIG. 13 is substantially similar to the retainer clip shown in FIGS. 3 and 4 except that prong 54 has been replaced with opposed arms 554 and 556. Arms 554 and 556 are similar in construction to those described in conjunction with the embodiment shown in FIG. 11.

Each arm 554, 556 includes a flexible portion 572, 574. First portion 560 is attached to third member 50 of rear part 510 and first portion 566 is similarly attached to an upturned extension 558 of web 61.

Figure 14:
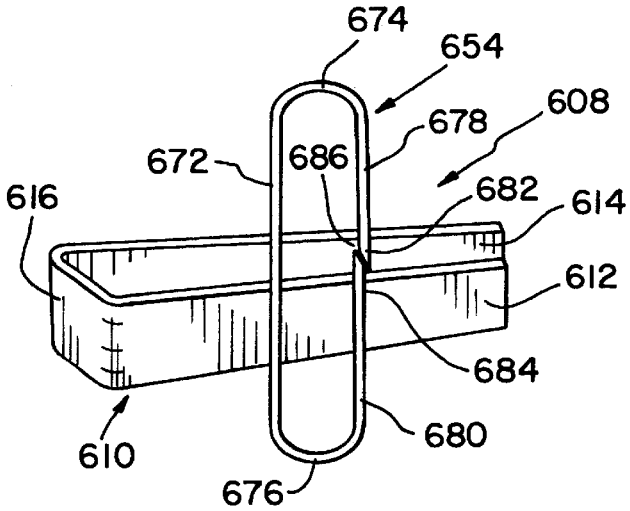
FIG. 14 is a perspective view of another embodiment of a retainer clip according to the present invention.

Rear part 610 of the embodiment shown in FIG. 14 is substantially the same as rear part 110 of the embodiment shown in FIGS. 9 and 9*a* except that third member 118 is not present. Rear part 610 includes first member 612 and second member 614 which are connected together by web 616. Prong 154 of the embodiment shown in FIGS. 9 and 9*a* has been replaced by a flexible pin 654 which is connected to rear part 610 in substantially perpendicular relationship. A first segment 672 of flexible pin 670 is welded or otherwise attached to first member 612. Curved segments 674, 676 extend from first segment 672. Third and fourth segments 678, 680 of flexible pin 654 extend from curved segments 674, 676 toward one another and in substantially parallel relationship to first segment 672. Ends 682, 684 of third and fourth parts 678, 680, respectively, are formed to overlap one another and to define a gap 686.

In operation, eyelet 44 of fastener part 12 is forced between ends 682, 684 through gap 686. The resiliency of flexible pin 654 causes ends 682, 684 to assume their original position (as shown in FIG. 14) after eyelet 44 has been inserted through gap 686. Accordingly, eyelet 44 is prevented from accidentally becoming disengaged with flexible pin 654.

Figure 15:
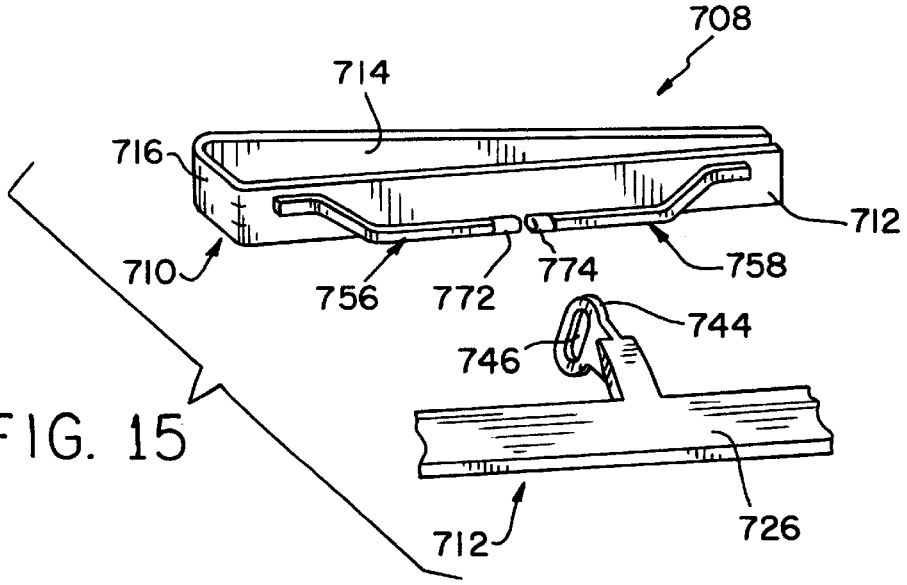
FIG. 15 is a fragmented, perspective view of another embodiment of a tie retaining device according to the present invention.

The rear part 710 of retainer clip 708 shown in FIG. 15 is substantially similar in construction to rear part 610 of FIG. 14. Flexible pin 654 has been replaced with a pair of opposed arms 756, 758, each having flexible segments 772, 774. In this embodiment, arms 756, 758 are attached to first member 712 such that they extend substantially parallel to first member 712 and substantially perpendicular to centerline 100 when retainer clip 708 is attached to shirt 22. As such, a modified fastener part 712 (shown fragmented in FIG. 15) may be used. Fastener part 712 is substantially similar to fastener part 12 of FIGS. 2 and 8 in all regards except that eyelet 744 is rotated 90 degrees relative to eyelet 44. Accordingly, when eyelet 744 is urged between flexible segments 772, 774, eyelet 744 may move along arms 756, 758 which extend through opening 746. As should be apparent from the foregoing, retainer clip 708 permits lateral movement of fastener part 712 relative to retainer clip 708. Of course, the fastener part 12 shown in FIGS. 2 and 8 may also be used with retainer clip 708.

Figure 16:
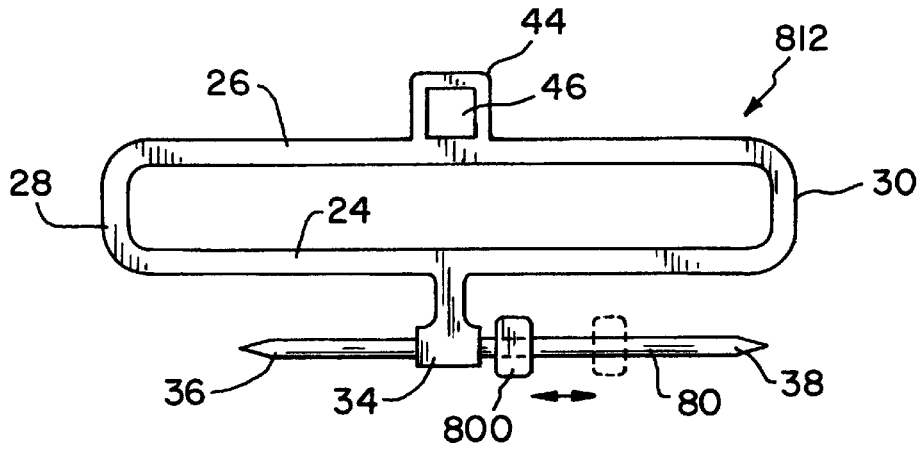
FIG. 16 is a top plan view of another embodiment of a fastener part according to the present invention.
Figure 17:
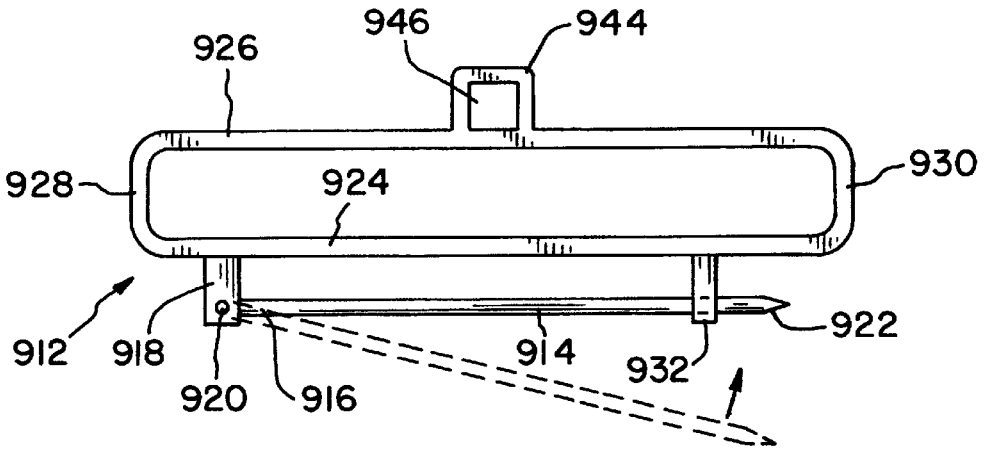
FIG. 17 is a top plan view of another embodiment of a fastener part according to the present invention.
Figure 18:
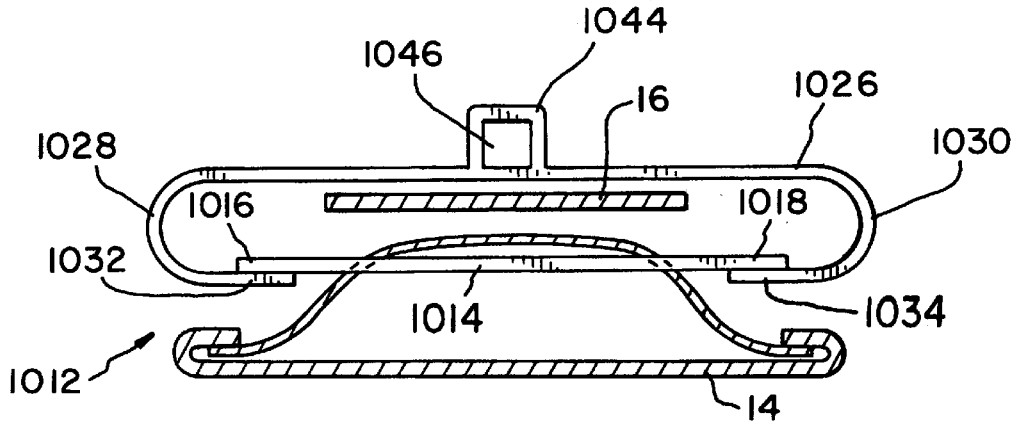
FIG. 18 is yet another embodiment of a fastener part according to the present invention.

FIGS. 16 through 18 show alternate embodiments of fastener part 12 of FIGS. 2 and 8. Each of the fastener parts shown in FIGS. 16 through 18 may be used in conjunction with any of the retainer clips described above as well as the retainer chain shown in FIG. 7. Fastener part 812 of FIG. 16 is substantially similar to fastener part 12 of FIG. 8, except that a slide 800 has been added. Slide 800 may be made from a variety of materials and formed in a variety of shapes including a flexible plastic ring which is threaded onto barb 38 of double pointed pin 80. As described above, barb 38 is longer than barb 36 and is therefore inserted first into one flap portion of tie body 14. Once fastener part 812 is attached to tie body 14 as described above, slide 800 is moved along barb 38 into the position shown in dotted lines of FIG. 16 which is preferably adjacent or in contact with tie body 14. As such, slide 800 resists the accidental disengagement of barb 38 from tie body 14.

Fastener part 912 of FIG. 17 includes a front side 924, a back side 926, and a pair of end segments 928, 930. Back side 926 includes an eyelet 944 which includes an eyelet opening 946. Front side 924 includes a support 918 and pivot rod 920. Pivot rod 920 extends through one end 916 of pin 914, thereby facilitating the pivotal movement of pin 914 relative to front side 924 (as indicated by the dotted lines in FIG. 17). When pin 914 is pivoted away from front side 924, it may be threaded through tie body 14. After pin 914 is attached to tie body 14, pin 914 is pivoted toward front side 924. End 922 of pin 914 is then received by pin retainer 932 which is also attached to front side 924 of fastener part 912. Pin retainer 932 may take a variety of forms, all suitable for receiving pin 914, including a clasp, hook, or slotted projection.

FIG. 18 shows a final embodiment of a fastener part according to the present invention. Fastener part 1012 includes a back side 1026 and end segments 1028, 1030. Back side 1026 includes an eyelet 1044 which has an eyelet opening 1046. Tie tail 16 is threaded through fastener part 1012 as described above and shown in FIG. 6. End segment 1028 includes an extension 1032 which is substantially parallel to back side 1026. Similarly, end segment 1030 includes an extension 1034 which is substantially parallel to back side 1026. A pin 1014 extends between extensions 1032 and 1034. End 1016 of pin 1014 is attached to extension 1032.

End 1018 engages extension 1034. End 1018 may be bent or flexed away from extension 1034 and threaded through tie body 14. Once pin 1014 is threaded through tie body 14, end 1018 is repositioned back into engagement with extension 1034.

While this invention has been described as having exemplary embodiments, this application is intended to cover any variations, uses, or adaptations of the invention using its general principles. Further, this application is intended to cover such departures from the present disclosure as come within the known or customary practice within the art to which it pertains. The spirit and scope of the invention are to be limited only by the terms of the appended claims.

What is claimed is:

1. A tie retaining device; comprising:

a fastener part for removably connecting to a tie; and a retainer clip including a rear part and a prong for removably connecting to the fastener part, the rear part including a first member and a second member, the first and second members being movable between an opened and a closed position wherein the retainer clip is attached to a portion of a shirt.

2. The device of claim 1 wherein the first and second members are connected together by a web.

3. The device of claim 2 wherein the web extends between one end of the first member and one end of the second member.

4. The device of claim 2 wherein the web is resilient, the web being formed to position the first and second members in the closed position when the web is in a relaxed state.

5. The device of claim 1 wherein the first member engages one side of a centerline of the shirt and the second member engages an opposite side of the centerline when the first and second members are in the closed position.

6. The device of claim 5 further comprising a projection connected to one of the first member and the second member, the projection engaging the centerline when the retainer clip is in the closed position.

7. The device of claim 1 wherein the first and second members are biased toward one another to cooperatively compress the shirt portion when in the closed position.

8. The device of claim 1 further comprising an actuator connected to one of the first member and the second member, the actuator being movable between a first and a second position wherein the actuator causes the first member and the second member to move into the closed position.

9. The device of claim 8 wherein the first member includes an opening, the actuator including a rod which extends through the first member opening, and a projection which engages the second member when the actuator is in the second position.

10. The device of claim 9 wherein the first member opening is a slot, the rod being movable within the slot.

11. The device of claim 8 wherein the first member includes an opening, the second member includes and opening, and the actuator includes a rod extending through the first and second member openings, the actuator having a projection which engages one of the first and the second members when the actuator is in the second position.

12. The device of claim 11 wherein the first and second member openings are slots, the actuator being movable within the slots.

13. The device of claim 8 wherein the first member is pivotally connected to the second member.

14. The device of claim 8 wherein the actuator is a spring.

15. The device of claim 1 further comprising an actuator, the actuator partially encircling the first and second members, the actuator being movable between a first position and a second position wherein the actuator causes the first and second members to move into the closed position.

16. The device of claim 15 wherein the first and second members include detents to retain the actuator.

17. The device of claim 1 wherein one end of the prong is connected to the first member and the other end of the prong is supported adjacent a third member connected to the first member.

18. The device of claim 17 wherein the prong includes a first segment adjacent the third member and a second segment spaced away from the third member.

19. The device of claim 1 further comprising a biasing member connected to the first member, one end of the prong being connected to the biasing member, the other end of the prong being supported adjacent a third member connected to the first member.

20. The device of claim 19 wherein the biasing member is a spring.

21. The device of claim 1 further comprising a retainer chain having a clasp on one end for removably coupling to the fastener part and a rod on the other end, the retainer chain and the retainer clip interchangeably providing coupling between the fastener part and the shirt.

22. A tie retaining device, comprising:

a fastener part for removably connecting to a tie; and a retainer clip including a rear part and a pair of arms attached to the rear part, each of the arms being offset from the rear part and having an end, one end of one arm being adjacent one end of the other arm.

23. The device of claim 22 wherein the rear part includes a first member and a second member, the first and second members being movable between an opened and a closed position wherein the retainer clip is attached to a portion of a shirt.

24. The device of claim 23 wherein the other end of one of the arms is connected to the first member.

25. The device of claim 24 wherein the other end of the other arm is connected to a third member which is connected to the first member.

26. The device of claim 22 wherein the one end of each of the arms carries a flexible member, the flexible members defining a gap for receiving the fastener part.

27. The device of claim 22 wherein the arms are substantially aligned along an axis, the arms being oriented substantially parallel to a centerline of the shirt.

28. The device of claim 22 wherein the arms are substantially aligned along an axis, the arms being oriented substantially perpendicular to a centerline of the shirt.

29. The device of claim 22 further comprising a retainer chain having a clasp on one end for removably coupling to the fastener part and a rod on the other end, the retainer chain and the retainer clip interchangeably providing coupling between the fastener part and the shirt.

30. A tie retaining device, comprising:

a fastener part for removably connecting to a tie; and a retainer clip including a rear part and a flexible pin attached to the rear part, the rear part including a first member and a second member which cooperatively engage a centerline of a shirt, the flexible pin including a first segment connected to the first member and third and forth segments connected to the first segment.

31. The device of claim 30 wherein the third and fourth segments are substantially aligned on an axis, the third segment having an end and the fourth segment having an end adjacent the third segment end thereby defining a gap for receiving the fastener part.

32. The device of claim 30 wherein a first curved segment connects the third segment to the first segment a second curved segment connects the fourth segment to the first segment.

33. The device of claim 30 further comprising a retainer chain having a clasp on one end for removably coupling to the fastener part and a rod on the other end, the retainer chain and the retainer clip interchangeably providing coupling between the fastener part and the shirt.

34. A tie retaining device, comprising:

fastener part means for removably connecting to a tie;

retainer clip means including rear part means for removably connecting to a shirt and prong means for removably connecting to the fastener part means; and retainer chain means for removably connecting to the shirt, the retainer chain means and the retainer clip means interchangeably providing coupling between the fastener part means and the shirt.

35. A tie retaining device, further comprising:

a fastener part having a front side and a back side connected together in substantially parallel relationship by a pair of end segments, the front side being connected to one end of a pin, the other end of the pin being movable away from the front side into a disengaged position, and toward the front side into an engaged position wherein the pin is connected to a pin retainer; and a retainer clip including a rear part and a prong for removably connecting to the fastener part.

36. A tie retaining device, comprising:

a fastener part having a front side and a back side connected together in substantially parallel relationship by a pair of end segments, the front side being connected to one end of a pin, the other end of the pin being movable away from the front side into a disengaged position, and toward the front side into an engaged position wherein the pin is connected to a pin retainer; and a retainer clip including a rear part and a prong for removably connecting to the fastener part, and a retainer chain having a clasp on one end for removably coupling to the fastener part and a rod on the other end, the retainer chain and the retainer clip interchangeably providing coupling between the fastener part and the shirt.

37. A tie retaining device, comprising:

a fastener part having a back side, a pair of end segments connected to the back side, each end segment having an extension which extends in axial alignment toward the extension of the other end segment, both extensions being substantially parallel to the back side, and a pin extending between the extensions, the pin having a first end connected to one extension and a second end being movable into and out of engagement with the other extension; and a retainer clip including a rear part and a prong for removably connecting to the fastener part.

38. A tie retaining device, comprising:

a fastener part having a back side, a pair of end segments connected to the back side, each end segment having an extension which extends in axial alignment toward the extension of the other end segment, both extensions being substantially parallel to the back side, and a pin extending between the extensions, the pin having a first end connected to one extension and a second end being movable into and out of engagement with the other extension; and a retainer clip including a rear part and a prong for removably connecting to the fastener part, and a retainer chain having a clasp on one end for removably coupling to the fastener part and a rod on the other end, the retainer chain and the retainer clip interchangeably providing coupling between the fastener part and the shirt.

* * * * *